United States Patent [19]

Wiggs et al.

[11] Patent Number: 4,553,754

[45] Date of Patent: Nov. 19, 1985

[54] BEAD PUZZLE

[76] Inventors: Christopher C. Wiggs, 48A Queenstown Rd., London, England, SW8 3RY; Christopher J. Taylor, Flat 3, 17 Queensgate Pl., London, England, SW7

[21] Appl. No.: 348,825

[22] Filed: Feb. 16, 1982

[30] Foreign Application Priority Data

May 1, 1981 [GB] United Kingdom ..... 8113543

[51] Int. Cl.[4] ..... A63F 9/08

[52] U.S. Cl. ..... 273/153 S

[58] Field of Search ..... 273/153 R, 153 S, 109, 273/110, 111, 113, 281; 46/43; 40/409; 434/174

[56] References Cited

U.S. PATENT DOCUMENTS

| | | | |
|---|---|---|---|
| 332,211 | 12/1885 | Protheroe | 273/153 S |
| 479,475 | 7/1892 | Stutz | 273/109 |
| 669,452 | 3/1901 | Ashby et al. | 273/113 |
| 1,560,921 | 11/1925 | Von Butzingslowen | 273/153 S |
| 2,979,834 | 4/1961 | Giles | 273/153 S X |
| 3,239,951 | 3/1966 | Benson | 434/174 |
| 3,610,628 | 10/1971 | Promin | 273/138 R |

FOREIGN PATENT DOCUMENTS

| | | | |
|---|---|---|---|
| 422605 | 12/1925 | Fed. Rep. of Germany | 273/109 |
| 2405077 | 6/1979 | France | 273/153 S |

*Primary Examiner*—Anton O. Oechsle

*Attorney, Agent, or Firm*—John M. Cone

[57] ABSTRACT

A puzzle comprises at least two relatively rotatable members in contact with one another and pivoted together about an axis normal to their contact plane. Exterior surfaces of the members are formed with tracks having their entry and exit points disposed equi-angularly about said axis and equidistant therefrom in said contact plane. Accordingly relative rotation of the members in equiangular steps brings about alignment of the several tracks in different configurations. A multiplicity of movable elements substantially fill the tracks and are displaceable therealong when the tracks in the first member are aligned with those in the second. The puzzle may in its initial position have circular tracks each filled with beads of a different color or marking, the puzzle being manipulated to randomise the beads and then to return them to their original pattern or to form another intended pattern.

27 Claims, 22 Drawing Figures

BEAD PUZZLE

BACKGROUND OF THE INVENTION

The present invention relates to a bead puzzle.

FIELD OF THE INVENTION

Manipulative puzzles such as the Rubik's cube are very popular. We have devised a bead puzzle which requires for its solution a similar combination of intellectual and manipulative skills, has a wide appeal over a broad age and ability spectrum, and can be made aesthetically attractive.

SUMMARY OF THE INVENTION

Broadly stated the invention provides a puzzle comprising at least two members in contact with one another at a division line, means in the members defining tracks that interconnect two points spaced apart along the division line so that relative movement of the members along the division line in steps connects the several tracks into paths of different configuration and a multiplicity of distinguishable elements substantially filling the tracks and displaceable along paths formed when tracks in one member are connected with those in the other.

DESCRIPTION OF PREFERRED FEATURES

The tracks may be formed in the exterior surfaces of a pair of members that are solids of revolution, meet at a division line that is the circumference of a circle and are pivoted for rotation about an axis normal to the division line that passes through its centre. The shape of the relatively rotatable members is not restricted except for the need for the tracks to meet at a circle and for them to register. Thus the two members are preferably hemispherical and define a globe but they could together define a cylinder, a waisted cylinder, a lozenge having a cylindrical centre and rounded ends, an ellipse or any other shape developed from a circle. And although in the simplest form of the puzzle there are two relatively rotatable members, in other forms there may be three or more such members in plane contact with one another. The tracks may project from the surface of the circular members but are preferaby recessed therein and are preferably of inverted T-profile so that flanged beads can locate thereon.

Preferably the members can be rotated to an unperturbed position in which the tracks are joined to define paths disposed in a pattern that is apparently unchanged after a $C_2$ symmetry operation about the axis of rotation, said paths being directed parallel to one another and perpendicular to the division line. There may be from three to six such paths, preferably four. In another preferred arrangement the members can be rotated to an unperturbed position in which the tracks are joined to define paths that are perpendicular to the division line and are disposed in a pattern that is apparently unchanged after a $C_n$ symmetry operation about the axis, n being an integer at least equal to 3. Thus the paths may recur at angular intervals of 120° relative to the axis of relative rotation of the hemispheres and they may be disposed in groups parallel to one another. There may be three groups of paths with two paths in each group. Another preferred puzzle takes the form of a globe divided by a pair of orthogonal great circle division lines into four lunes that are supported for relative rotation in pairs in indexed steps about each division line, tracks in the exterior surfaces of the lunes defining in an unperturbed state of the puzzle circular paths along which the elements can be displaced. A yet further puzzle takes the form of a globe divided by three othogonal great circle division lines into eight half-lunes that are supported for relative rotation in fours in indexed steps about each division line, tracks in the exterior surfaces of the half-lunes defining in an unperturbed state of the puzzle circular paths along which the elements can be displaced.

In a further aspect the invention provides a bead for a bead puzzle slideable in a trackway comprising a generally hemispherical light-collecting front surface and a part spherical rear surface that is lined or otherwise formed to generate confused light, the arrangement of the front and rear surfaces being such that the rear surface appears illuminated when viewed from the front and remains apparently bright over a wide range of viewing angles.

BRIEF DESCRIPTION OF DRAWINGS

Various embodiments of the invention will now be described by way of example only with reference to the accompanying drawings in which.

DESCRIPTION OF PREFERRED EMBODIMENTS

Figure 1:
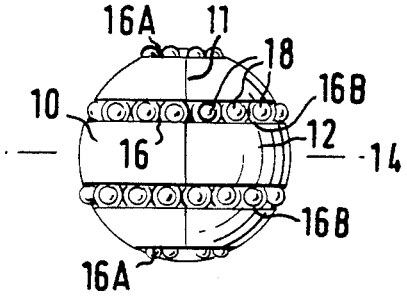
FIG. 1 is an equatorial view of a first bead puzzle of spherical shape formed in rotatable hemispheres which are in a first relative position in which the beads are in circular paths.

In FIG. 1 a puzzle globe is defined by a first hemisphere 10 and a second hemisphere 12 that meet at a polar great circle division line 11 and are pivoted together about an equatorial axis 14 and are formed with a symmetrical pattern of tracks 16 that are joined to define (in the FIG. 1 position of elements 10,12) circulation paths disposed in a pattern of two pairs of concentric small circles with, in the embodiment shown, two "polar" tracks 16A and two "tropical" tracks 16B. In fact, as best seen from FIG. 14 the entries to the tracks 16A and 16B are disposed in each hemisphere 10, 12 symmetrically about the rotational axis 14. A detent may be provided so as to locate accurately the positions where the tracks 16A, 16B coincide.

A multiplicity (in this case 56) of beads or elements 18 locate in substantially abutting relationship in the several tracks 16A and 16B. By substantially abutting is meant that in the positions (FIGS. 5 and 6) where all the tracks 16A and 16B are joined to define a circulation path that is continuous about the surface of the sphere there is insufficient space to allow the puzzle to be moved with an asymmetrical distribution of the beads between the hemispheres and it is desirable that no gap greater than half of a bead diameter should be able to develop between any pair of beads. Conveniently the tracks may be recessed into the surface of the elements 10, 12 and are of inverted T section (FIGS. 14 and 15) and the beads 18 are flanged at 20 so that they remain captive in the tracks. The beads 18 should be identifiable so that the effects of manipulation of the puzzle can be perceived and for this purpose there may be provided two or more sets of beads having different identifying characteristics. The beads on each set may carry various markings. Thus an equal number of red and white beads may be provided, or sets of three or four or five or even six differently coloured beads or any further number of different colours as may be required to make an interesting puzzle may be provided or the beads may bear patterns, letters or numbers. In the puzzle as sold, for example, each track 16A, 16B may be filled with beads of a particular colour or pattern, the aim of the user being to randomise the bead distribution and then return the puzzle to its original state or to create new and aesthetically pleasing bead distribution. There may be eight beads in each small or polar ring and twenty beads in each great or equatorial ring and in an initial state of the puzzle the beads in each ring form a set differently coloured from the beads in the other rings. The beads in each great ring may be differently coloured if desired.

Figure 5:
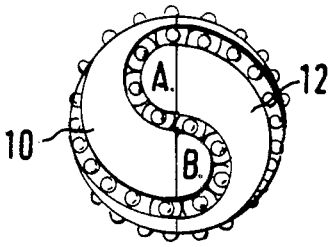
FIG. 5 is a polar view of the puzzle with the left hemisphere rotated 45° anticlockwise relative to the right hemisphere to define a continuous pathway in which the beads have a one-handed circulation pattern.
Figure 2:
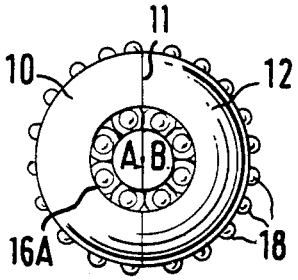
FIG. 2 is a polar view of the bead puzzle of FIG. 1 with the rotatable hemispheres in the first relative position.
Figure 6:
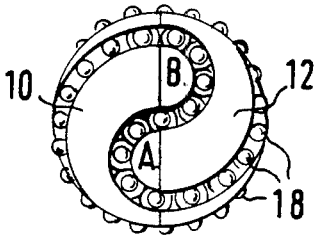
FIG. 6 is a polar view of the puzzle with the left hemisphere rotated 45° clockwise relative to the right hemisphere to define another continuous pathway in which the beads have a differently handed circulation pattern.
Figure 3:
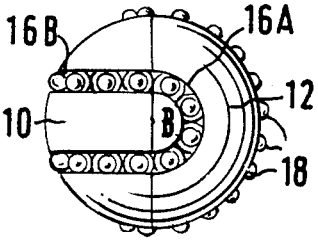
FIG. 3 is a polar view of the puzzle with the left hemisphere rotated through 90° to define a pair of orthogonal oval paths.
Figure 4:
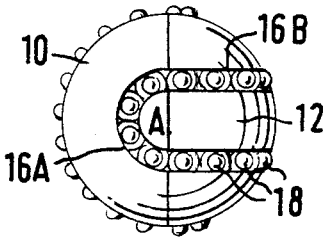
FIG. 4 is a polar view of the puzzle with the right hemisphere rotated to define another pair of orthogonal oval paths.
Figure 7:
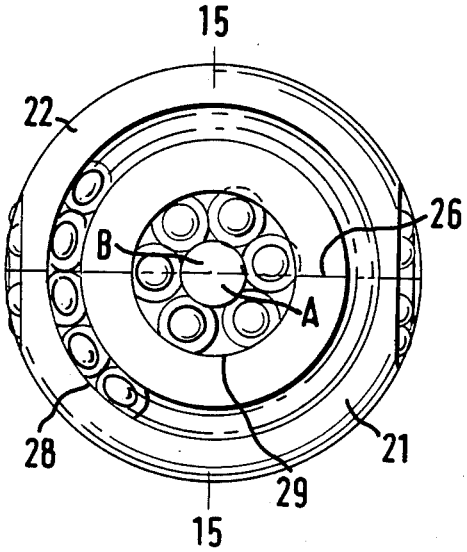
FIG. 7 is an equatorial view of a second bead puzzle of spherical shape formed in rotatable hemispheres which are in a first relative position defining a pattern of three pairs of concentric bead paths.
Figure 8:
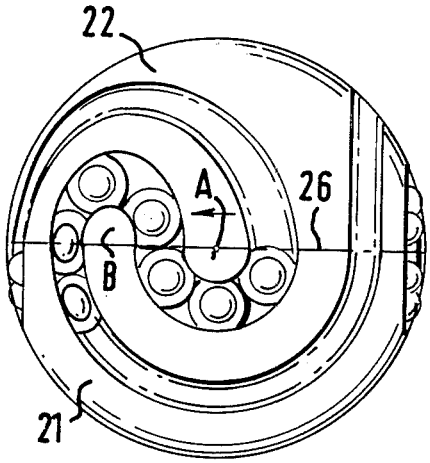
FIG. 8 is a view like FIG. 7 but with the upper hemisphere rotated through a single rotational step anticlockwise to define a single continuous pathway in which there is a first circulation pattern.
Figure 10:
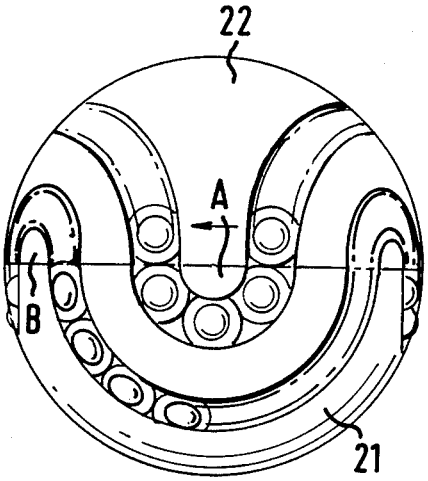
FIG. 10 is a view like FIG. 7 but with the upper hemisphere rotated anti-clockwise through two rotational steps to define a pair of non-intersecting sinuous pathways extending around the circumference of the sphere.
Figure 9:
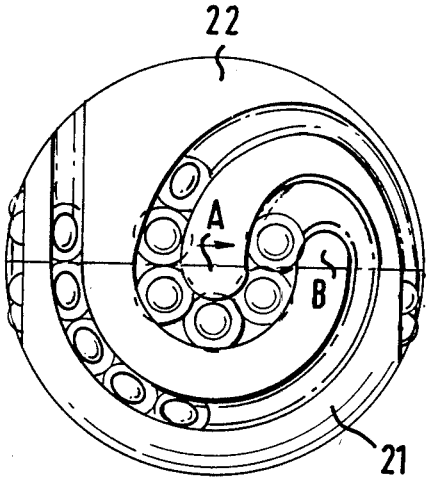
FIG. 9 is a view like FIG. 7 but with the upper hemisphere rotated clockwise through a single rotational step to define a single continuous pathway in which there is a second circulation pattern.

In FIGS. 1 and 2 the tracks 16A and 16B are aligned so as to form circulation paths that are small circles. In FIG. 3 which is two rotational steps or 90° away from FIGS. 1 and 2 th left hand hemisphere has been rotated to align the polar tracks 16A of the right hand hemisphere 12 with the equatorial tracks 16B of the left hand hemisphere 10. The result is to create a pattern of two independent orthogonal circulating paths disposed in a "tennis-ball" pattern. Each circulating path is defined by an oval trackway which projected onto a flat surface would have parallel sides linked by semicircular ends. In FIG. 3 a reference polar region B of hemisphere 12 remains uppermost as viewed in FIG. 1 and it will be appreciated that there are two possible positions of hemisphere 10 that are spaced 180° apart and bring opposite ends of the trackways 16B on hemisphere 10 into registration with reference polar region B. FIG. 4 is similar to FIG. 3 but defines a different set of orthogonal circulating paths. Now reference polar region A of hemisphere 10 is uppermost as viewed in FIG. 1 and again there are two rotational positions of hemisphere 12 that can achieve this configuration. In FIGS. 5 and 6 the reference polar regions A and B are only a single 45° rotational step apart and the several tracks 16A, 16B of the two hemispheres are all interconnected to define a "swirl pattern" in which all the beads 18 can be displaced simultaneously. But the swirl pattern can be left handed or right handed (FIG. 5 or FIG. 6) the two patterns each being achievable by two rotational positions of hemispheres 10, 12 that are 180° apart.

The path configuration of a puzzle of the present kind is best described with reference to its "unperturbed" state in which reference regions A and B within the smallest of the circles in each group are in register. Thus in its unperturbed state (FIG. 1) the puzzle first described has a pattern of circulation paths in the form of two pairs of concentric circles directed perpendicular to the division line and whose planes lie parallel to the axis 14 of relative movement of said hemispheres and are offset therefrom. It would, of course, be possible to introduce an additional pair of circular paths in each hemisphere between path 16A and path 16B which would then be appropriately relocated to give a 6-track puzzle.

FIGS. 7–10 illustrate a puzzle in which the two hemispheres 21, 22 have three groups of circular trackways disposed at 120° intervals about a polar rotational axis 15 so as to form a belt that surrounds an equatorial division line 26. Each group consists of an outer track 28 and a concentric inner track 29 dimensioned and positioned so that the hemispheres 21, 22 can be relatively rotated in 45° steps and at each index position the tracks in one hemisphere all align with the tracks within the other hemisphere. As before, A and B represent small reference areas of the shell or body of the puzzle enclosed by the track 29. Indexing the upper hemisphere 22 anti-clockwise (FIG. 8) or clockwise (FIG. 9) through one 30° step interconnects all the circular tracks 28, 29 end to end to define a single circulation path in either a left-handed or a right-handed swirl pattern along which all the sliding beads may be displaced simultaneously. Indexing the hemisphere 22 by 60° relative to hemisphere 20 results in the configuration shown in FIG. 10 in which there are two sinuous nonconnected circulation paths of which one is predominantly towards hemisphere 20 and the other is towards hemisphere 22.

Instead of the pattern of three pairs of paths there could be employed a pattern of three groups of three concentric circular paths. In that case, as one hemisphere is displaced relative to another, the path pattern changes from groups of concentric circles successively to (1) a single continuous path, (ii) separate closed loops and (iii) three unconnected sinuous paths.

Figure 14:
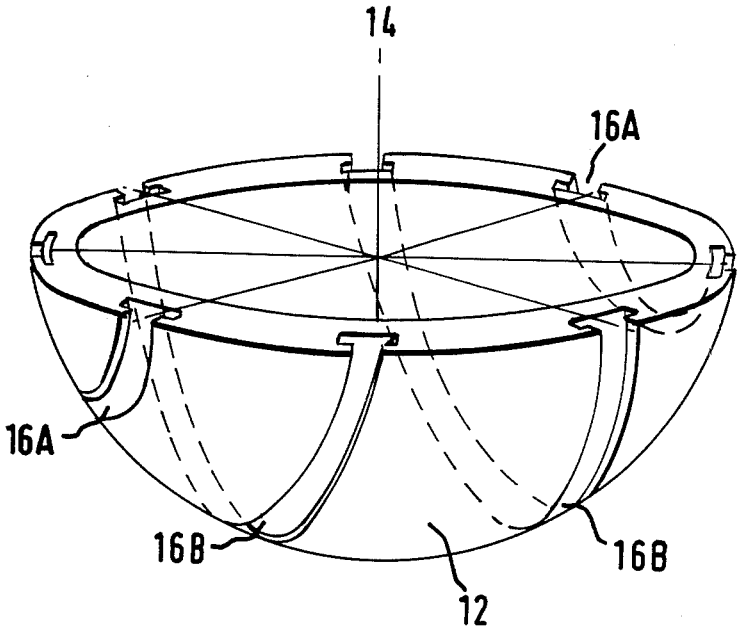
FIG. 14 is an internal view of another and simpler constructional form of the puzzle of FIG. 1 that consists of two shell structures screwed together.
Figure 15:
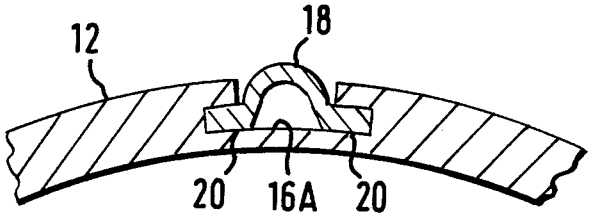
FIG. 15 is a fragmentary sectional view of the puzzle of FIG. 14 showing a bead in a trackway.

The simple mechanism of FIGS. 14 and 15 is not preferred for a puzzle of the present kind because the screw connecting the two hemispheres shows from the outside and even if closed off by a plug, some junction will be visible. What is preferred is a structure that is completely constructed from within so that when the two hemispheres are fitted together, there is no visible connection from the outside and all that is presented to the user is trackways, beads and plain smooth portions of the circular puzzle shell. A preferred mechanism for the puzzle of FIG. 1 is illustrated in FIG. 11.

Figure 11:
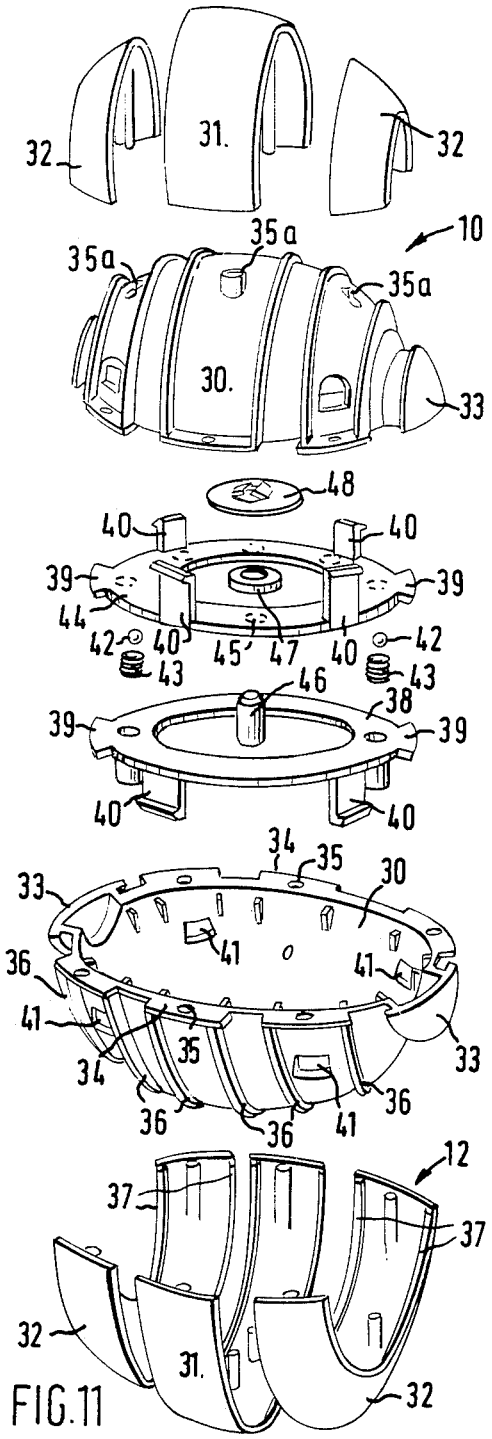
FIG. 11 is an exploded view of the bead puzzle of FIG. 1 (the beads being omitted) to show its internal components.

In FIG. 11, each hemisphere 10, 12 is defined by an inner hemispherical shell 30, an equatorial outer cover piece 31, and a pair of upper and lower outer tropic cover pieces 32. Polar regions 33 of the puzzle are formed as projecting end regions of the inner shell 30 formed integrally therewith. Except in the polar regions 33 and the trackway regions the shell 30 is formed with an outwardly directed peripheral flange 34 formed with fixing holes 35 and it also has on its outer surface locating ribs 36. The cover pieces 31, 32 are formed on their inner face with fixing pegs and also have locating ribs 37 that fit outside the ribs 36 of the inner shell to define the sides of bead tracks and to locate the cover pieces relatively to the inner shell. Additionally a pair of pegs on the inner face of equatorial cover piece 31 and single pegs on the tropical pieces 32 locate in corresponding sockets 35*a* on the inner shell 30. Thus the cover pieces can be fitted onto the inner shell and fixed in position by the pegs that pass through the holes 35 and locate in sockets 35*a*. The tracks 16A are defined between the tropical cover pieces 32 and polar regions 33 and the tracks 16B are defined between the equatorial cover piece 31 and the tropical cover pieces 32. And because the exterior surfaces of regions 31, 32, 33 overhang the bead tracks as shown, the bead tracks are internally of inverted T section and slideably retain flanged beads. A ball catch plate 38 has locating ears 39 that fit into sockets behind the polar regions 33 to prevent relative rotation between catch plate 38 and inner shell 30 and on its concealed face has four legs 40 formed at their ends with latching projections that snap into fixing holes 41 in inner shell 30. Sockets in catch plate 38 contain springs 43 that act on balls 42. An index plate 44 fits into the other shell 30 and presents a circular trackway to the catch plate 38 that has eight depressions 45 disposed at 45° intervals around the axis of the plate.

To assemble the puzzle the springs 43 are placed in the sockets in the plate 38 and the balls 42 are located on top of them. The plate has an upstanding peg 46 which is engaged by a central through hole 47 in index plate 44 which is pressed fully down into face to face contact with the catch plate. A spring fixing washer 48 is then pushed onto the peg 46 to hold the resulting detent sub-assembly together. The pair of balls locate in the eight depressions 45 so that the index plate 44 can be rotated relative to the catch plate 38 but locks in one of eight accurately defined indexing positions and remains locked until positively moved to another position. The cover pieces 31, 32 are offered up to the inner shells 30 and glued or otherwise secured in place. Then the beads are placed in the tracks and the two hemisphere sub-assemblies located onto the detent sub-assembly by snap engagement of legs 40 in fixing holes 41. The puzzle is therefore constructed out of a relatively few standard parts that (except for washer 48, spring 43 and ball 42) may be injection moulded in plastics.

Figure 12:
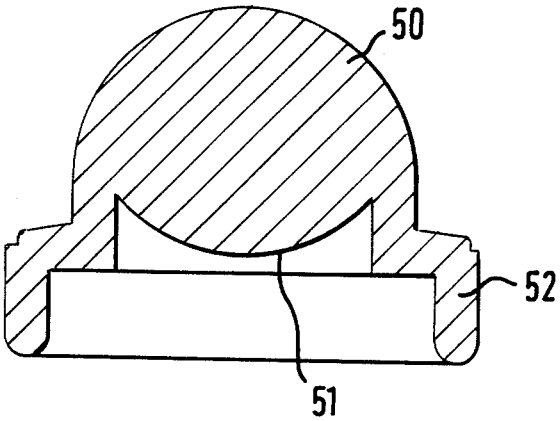
FIG. 12 is a vertical section through a bead that fits into a trackway in the puzzle of FIG. 1 or 7.
Figure 13:
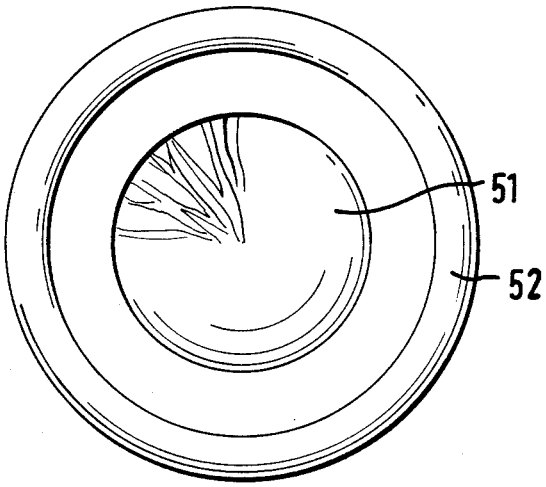
FIG. 13 is an underside view of the bead of FIG. 12.

The preferred bead is illustrated in FIGS. 12 and 13. It has a generally hemispherical top face 50 and a part spherical lower face 51 that act as its optical surfaces and is flanged at 52 to enable it slideably to fit into and be retained within the bead channels of the puzzle. The surface 51 is formed with generally radial but otherwise random serrations as most clearly seen in FIG. 13. The surface 50 has approximately the same radius of curvature as the surface 51 but the centre of curvature of surface 51 is raised relative to the centre of curvature of surface 50. The effect is that incident light is collected by surface 50 and illuminates surface 51 at which it is confused and internally reflected. The light may undergo multiple internal reflection and emergent light may be perceived by the user at substantially all angles from which the bead is visible. The surface 51 does not appear dark even though no light is incident on it and does not require a reflective coating in order to appear bright. The bead is inexpensive to manufacture and may be a single injection moulding in a clear or tinted plastics material such as polystyrene, polycarbonate, polyvinyl chloride, a styreneacrylonitrile copolymer or cellulose acetate butyrate. Other shapes for the bead could be used, for example it could have non-spherical surfaces which would need to be of a suitable complementary curvature, but this is not preferred. And it could be faceted like a diamond.

Figure 16:
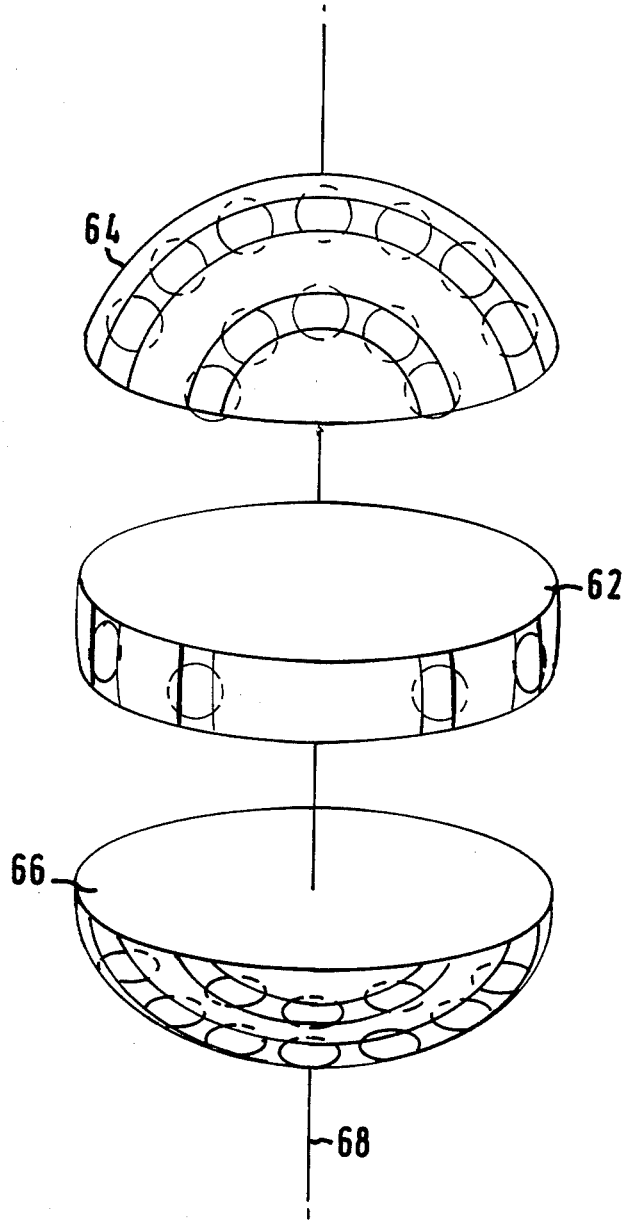
FIG. 16 is a diagrammatic view of a three-element puzzle otherwise similar to the puzzle of FIG. 1.

In FIG. 16 there is shown a further alternative arrangement for the puzzle in which cylindrical element 62 is interposed between hemispherical end elements 64, 66 each relatively rotatable about an axis 68. Tracks on the elements 62, 64, 66 carry movable beads as aforesaid.

Figure 17:
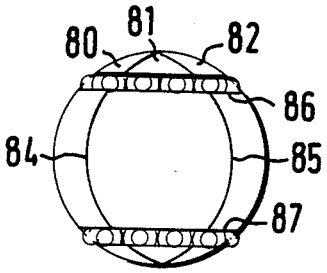
FIG. 17 is an equatorial view and FIG. 18 is a polar view in its unperturbed state of a further bead puzzle of four lune pieces.
Figure 18:
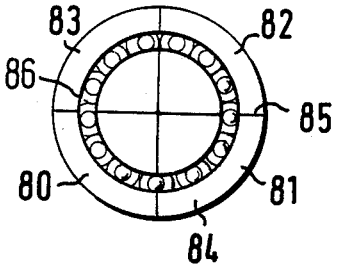
Figure 19:
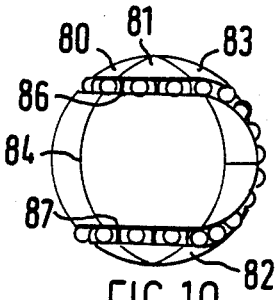
FIG. 19 is a view of the puzzle of FIG. 17 with the right-hand pair of lunes rotated through 90°.

A yeat further globe puzzle is shown in FIGS. 17, 18 and 19 in which a spherical shell 80 is symmetrically divided into four pieces or "lunes" 80–83 by a pair of orthogonal "polar" division lines 84, 85. In an unperturbed state of the puzzle upper and lower "tropical" small circle paths 86 and 87 are directed parallel to one another and in the state of the puzzle shown in FIG. 17 lie perpendicular to the division lines 84, 85. But rotation of one pair of segments relative to the other in either direction and along either division line 84, 85 interconnects the two tracks end to end to form a single oval path as shown. As before the paths 86, 87 are filled with beads in at least two differently coloured sets.

Figure 20:
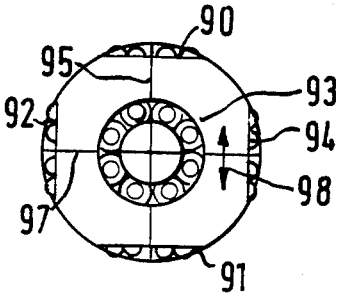
FIG. 20 is a view in its unperturbed state of a yet further puzzle of eight half-lune pieces.
Figure 21:
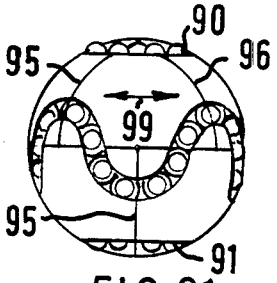
FIG. 21 is a view of the puzzle of FIG. 20 with the upper four lune pieces displaced one rotational step relative to the lower four lune pieces.

FIGS. 20 and 21 show a globe puzzle divided into eight segments or half-lunes defined by two orthogonal "polar" division lines and one "tropical" division line. An unperturbed state of the puzzle is shown in FIG. 20 and it will be seen that there are two "polar" paths 90, 91 and four "equatorial" circular paths 92, 93, 94 directed perpendicular to the polar paths. Each path is centred on a point of intersection of a "polar" cleavage plane 95 or 96 with the equatorial cleavage plane 97 ie. a point where four half-lunes meet. Rotation of four half-lunes about a horizontal axis in a 90° step (arrow 98) exchanges two pairs of polar half tracks with the corresponding two pair of equatorial half tracks. And rotation of four half-lunes in a step that is 45° or a multiple thereof (arrow 99, FIG. 21) interconnects all the equatorial tracks end to end to form a single continuous path.

Figure 22:
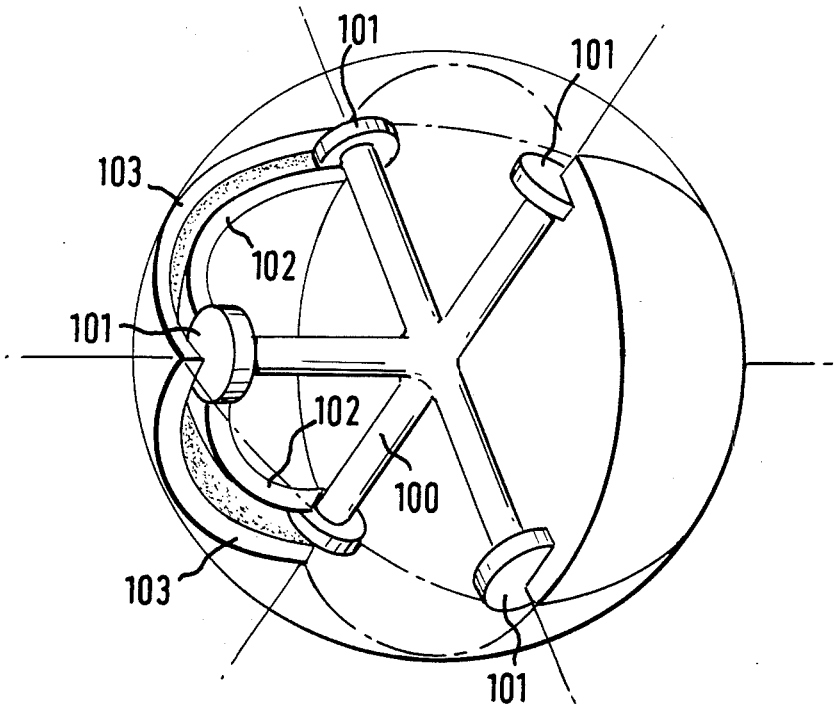
FIG. 22 is a diagram showing a possible internal mechanism for the puzzle of FIGS. 20 and 21.

A posssible internal mechanism for the puzzles of FIGS. 20, 21 is diagrammatically illustrated in FIG. 22. Each of the eight generally triangular half-lunes has tracked edges defined by an inner flange 102 and an outer flange 103. A body 100 has six retaining arms formed at their extremities with retaining discs 101 that are captured between the tracked edges of adjoining half-lunes as shown. One pair of the discs is in a position where each disc coincides with the junction of four half-lune segments and the half-lunes remain fixed relative to that pair of discs but are free to rotate thereon. The other four discs 101 can slide along the tracks to permit one half of the puzzle to be rotated relative to the other. To this end the body 100 is fixed to one of the segments so that segment will from its edge faces align all the other faces in the mechanism.

We claim:

1. A puzzle comprising at least two relatively movable members which are solids of revolution in contact with one another at a division line which is the circumference of a circle and which are pivoted for relative rotation about an axis normal to the division line that passes through its center, means in the members defining tracks in each member that interconnect two points spaced apart along the division line so that relative, step by step, movement between the members along the division line successively connects the several tracks into continuous paths of different configuration interconnecting the two members and a multiplicity of distinguishable elements substantially filling the tracks and displaceable along said paths formed when tracks in one member are connected with those in the other.

2. A puzzle according to claim 1, wherein the members can be rotated to an unperturbed position in which the tracks are joined to define paths disposed in a pattern that is apparently unchanged after a $C_2$ symmetry operation about the axis, said paths being directed parallel to one another and perpendicular to the division line.

3. A puzzle according to claim 2, wherein there are three such paths.

4. A puzzle according to claim 2, wherein there are four such paths.

5. A puzzle according to claim 2, wherein there are five such paths.

6. A puzzle according to claim 2, wherein there are six such paths.

7. A puzzle according to claim 1 wherein the members can be rotated to an unperturbed position in which the tracks are joined to define paths that are perpendicular to the division line and are disposed in a pattern that is apparently unchanged after a $C_n$ symmetry operation about the axis, n being an integer at least equal to 3.

8. A puzzle according to claim 7, wherein the paths recur at angular intervals of 120° about the axis of relative rotation of the solids of revolution.

9. A puzzle according to claim 8, wherein the paths are disposed in groups parallel to one another.

10. A puzzle according to claim 9, wherein there are three groups of paths with two paths in each group.

11. A puzzle according to claim 1 wherein said members form a globe.

12. A puzzle according to claim 1, wherein the tracks are defined by T-grooves recessed in th surface of the members and the movable elements are formed with retaining flanges that hold them captive in the tracks.

13. A puzzle according to claim 1, wherein detent means define the aligned positions of the members.

14. A puzzle according to claim 13, wherein said members are hemispherical shells and said detent means comprise a pair of plates secured for rotation on a common shaft, spring loaded balls in the concealed face of one plate engaging recesses on a trackway formed in the concealed face of the other plate to define the operating positions of the detent, and clamping fingers extending from the exposed faces of the plates that snap fit into recesses in the inner surfaces of the hemispherical shells to hold said shells together.

15. A puzzle according to claim 14, wherein each hemisphere comprises an inner shell formed on its outer surface with pairs of ribs between which are defined the tracks and cover pieces that fit over the ribs and define the outer shell.

16. A puzzle according to claim 1 wherein said members form a globe divided by a pair of orthogonal great circle division lines into four lunes that are supported for relative rotation in pairs in indexed steps about each division line, tracks in the exterior surfaces of the lunes defining in an unperturbed state of the puzzle circular paths along which the elements can be displaced.

17. A puzzle according to claim 1 wherein said members form a globe divided by three orthogonal great circle division lines into eight half-lunes that are supported for relative rotation in fours in indexed steps about each division line, tracks in the exterior surfaces of the half-lunes defining in an unperturbed state of the puzzle circular paths along which the elements can be displaced.

18. A puzzle according to claim 17, wherein in the unperturbed state of the puzzle a circular track surrounds each point where four half-lunes meet.

19. A puzzle according to claim 1, wherein different movable elements are distinctively coloured or marked.

20. A puzzle according to claim 19 wherein the elements are provided in two or more sets of similar elements, different sets being distinctively coloured or marked.

21. A puzzle according to claim 20, wherein there are at least 3 distinctively coloured or marked sets.

22. A puzzle according to claim 1 wherein each said distinguishable element is a bead slideably retained in said track and comprising a generally hemispherical light-collecting front surface, a part spherical rear surface that is lined or otherwise formed to generate confused light, the arrangement of the front and rear surfaces being such that the rear surface appears illuminated when viewed from the front over a wide range of viewing angles.

23. A puzzle according to claim 22 wherein each said bead is circular in plan and is formed at its base with a circular retaining flange.

24. A puzzle comprising two, relatively movable, members, which are solids of revolution, in contact with one another at a division line that is the circumference of a circle, said two members being pivoted for rotation about an axis normal to said division line that passes through the center of said circle, means in the members defining tracks in each member that interconnect two points spaced apart along the division line so that relative, step by step, movement between the members along the division line in successively connects the several tracks into continuous paths of different configuration interconnecting the two members and a multiplicity of distinguishable elements displaceable along said paths formed when tracks in one member are connected with those in the other.

25. A puzzle according to claim 24 wherein said distinguishable elements substantially fill said tracks.

26. A puzzle comprising at least two relatively movable members in contact with one another at a division line and movable with respect to each other along said division line, means in each of said members defining a plurality of tracks spaced along the division line, at least two of the tracks in at least two of said members connecting two points spaced along said division line, said plurality of tracks forming continuous paths between said members in at least two different positions of said members with respect to each other, and a plurality of elements of at least two distinguishable types substantially filling said plurality of tracks and being displaceable along said paths when said members are disposed in each of said at least two positions.

27. A puzzle comprising two generally hemispherical members, at least one circular member disposed between said hemispherical members, means maintaining said hemispherical members in abutting relationship with said circular member and enabling all of said members to be rotated relative to each other about a common axis, at least one closed track disposed on the exterior surface of each said hemispherical member, said tracks having spaced ends abutting said circular member, said circular member having at least two open tracks disposed on its exterior surface with opposite ends thereof abutting the respective abutting hemispherical members, said various tracks being so located on the respective members as to form at least one continuous closed path extending from the hemispherical members through the circular member, and a plurality of distinguishable elements substantially filling the tracks and being displaceable along said path when the tracks are aligned.

* * * * *